US006043753A

United States Patent [19]

Okayasu et al.

[11] Patent Number: 6,043,753

[45] **Date of Patent: *Mar. 28, 2000**

[54] REMOTE-CONTROL-OPERATED LOCKING/UNLOCKING SYSTEM

[75] Inventors: Yoshisada Okayasu, Tokyo; Keiji Morise, Chiba; Hiroaki Yamamoto, Tokyo, all of Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/910,273

[22] Filed: Aug. 13, 1997

[30] Foreign Application Priority Data

Aug. 23, 1996 [JP] Japan ..... 8-222429

[51] Int. Cl.[7] ..... A04Q 1/00; A04Q 7/00

[52] U.S. Cl. ..... 340/825.31; 340/825.34; 340/825.69; 340/825.72; 70/256; 70/262

[58] Field of Search ..... 340/525.31, 825.34, 340/825.72, 825.69, 425.5, 426, 825.31; 70/237, 256, 262, 278; 307/9.1, 10.1, 10.2

[56] References Cited

U.S. PATENT DOCUMENTS

| | | | |
|---|---|---|---|
| 4,742,426 | 5/1988 | Lavelle | 361/171 |
| 4,808,995 | 2/1989 | Clark et al. | 340/825.69 |
| 4,827,744 | 5/1989 | Namazue et al. | 70/252 |
| 5,412,379 | 5/1995 | Waraksa et al. | 340/825.72 |
| 5,608,272 | 3/1997 | Tanguay | 307/10.2 |
| 5,640,863 | 6/1997 | Frolov | 70/283 |
| 5,712,626 | 1/1998 | Andreou et al. | 340/825.31 |

*Primary Examiner*—William A. Cuchlinski, Jr.
*Assistant Examiner*—Yonel Beaulieu
*Attorney, Agent, or Firm*—Jay H. Maioli

[57] ABSTRACT

A remote-control-operated locking/unlocking system includes a key which transmits a locking/unlocking signal by remote control. A locking/unlocking unit is provided with a controller for controlling a locking/unlocking operation based on a locking/unlocking signal transmitted from the key. The controller has a suitability determining section for determining the suitability of a locking/unlocking signal transmitted from the key, and an information section for providing information indicating that the use of the key is unsuitable.

9 Claims, 7 Drawing Sheets

REMOTE-CONTROL-OPERATED LOCKING/UNLOCKING SYSTEM

BACKGROUND OF THE INVENTION

1. Field of the Invention

The present invention broadly relates to a remote-control-operated locking/unlocking system. More particularly, the invention relates to a remote-control-operated locking/unlocking system which determines the suitability of the use of a key that remotely controls a locking/unlocking unit installed in the door of a vehicle or a house, and which provides information concerning the unsuitable use of a key.

2. Description of the Related Art

Conventional types of locking/unlocking units installed in doors perform locking/unlocking operations either by being electrically powered by the remote control operation of a key or by directly inserting a key into a locking/unlocking unit and turning it.

In the locking/unlocking units that are locked or unlocked by being electrically driven by the remote control of a key, a button, for example, mounted on the key is pressed to generate a locking/unlocking signal and to drive a motor, thereby performing a locking/unlocking operation. Namely, in response to the locking/unlocking signal from the key, the suitability of the received locking/unlocking signal is determined in the locking/unlocking unit, and then, a motor serving as a driving source is driven to shift a locking/unlocking mechanism to a locking or unlocking position in a driven section.

When it is found that the locking/unlocking signal transmitted from the key is unsuitable, a locking/unlocking operation is not performed. On the other hand, when it is found that the locking/unlocking signal is suitable, a locking/unlocking operation is conducted. Whether or not the locking/unlocking signal transmitted from the key is suitable can be determined by the following manner. A rolling code contained in the locking/unlocking signal, which is variable every time a key is used, is compared with an expectation value included in the controller of the locking/unlocking unit, which value is preset to identify the key. Upon this comparison, if it is found that the matching state between the rolling code and the expectation value is within a predetermined range or conforms to predetermined rules, the operated key can be determined to be suitable. If it is desired, therefore, that the use of a certain key should be prohibited due to the loss or theft of the key, the operation panel of the controller can be actuated to erase the identification code which specifies the key from a data group. This operation prevents the execution of the locking/unlocking operation even though the key is used. Further, in addition to the identification code for identifying a group consisting of a plurality of keys, an intra-group identification code for identifying the individual keys within a specific group may be used to determine the suitability of a locking/unlocking signal transmitted from the key. Thus, the frequency of erroneous operations can be decreased.

In the above-described locking/unlocking system which performs a remote control operation with a key, security measures for locking/unlocking the locking/unlocking unit are taken against the loss and erroneous operations of the key by providing identification codes corresponding to the respective groups, each consisting of a plurality of keys. If it is found, however, that the operated key is not suitable for the locking/unlocking unit, a locking/unlocking operation is not carried out. Accordingly, the reason for a failure in performing locking/unlocking operation is unknown, and what causes the failure is not clarified, either.

SUMMARY OF THE INVENTION

Accordingly, in view of the above background, it is an object of the present invention to provide a remote-control-operated locking/unlocking system in which the security achieved by the locking/unlocking system that performs a locking/unlocking operation by remote control is fully implemented.

It is another object of the present invention to provide a remote-control-operated locking/unlocking system in which the user is able to know the reason for a failure in the locking or unlocking of the locking/unlocking unit.

In order to solve the above problems, according to one aspect of the present invention, there is provided a remote-control-operated locking/unlocking system comprising: a key which transmits a locking/unlocking signal by remote control; and a locking/unlocking unit having control means for controlling a locking/unlocking operation based on the locking/unlocking signal transmitted from the key, the control means including determining means for determining the suitability of a locking/unlocking signal transmitted from the key, and information means for providing information indicating that the unsuitable use of the key based on a determination made by the determining means.

In the above locking/unlocking system, the key may comprise a counter which variously outputs the value every time the locking/unlocking signal is transmitted, a transmitting storage section which stores a predetermined code and the value of the counter, a transmitting controller which encodes the locking/unlocking signal in accordance with the predetermined code and the value of the counter stored in the transmitting storage section, a modulator which modulates the locking/unlocking signal encoded by the transmitting controller, and a transmitting output section which outputs the locking/unlocking signal modulated by the modulator. The above-described predetermined code may comprise an identification code, and a rolling code which varies by the use of the key in accordance with a predetermined rule. Further, the identification code may comprise an individual identification code which is unique to a key, and an intra-group identification code which specifies each of a plurality of keys formed into a group.

Moreover, the locking/unlocking unit may comprise a locking/unlocking mechanism which is driven by the operation of the key, a driven section which shifts the locking/unlocking mechanism to a locking/unlocking position, a driving section having a clutch that transmits power from a driving source to the locking/unlocking mechanism, and a controller which receives the locking/unlocking signal from the key so as to determine the suitability of the use of the key, and upon determination, drives the driving section. The locking/unlocking unit may also comprise a power supply section. The above-described controller and the power supply section may be integrally formed with each other and made detachable. The driven section may perform a locking/unlocking operation either by being driven by the power supply section or by inserting the key into a lock.

Further, the information means may comprise means for providing an alarm which represents the unsuitable use of the key and/or informing the contents of the unsuitable use of the key by communications.

According to another aspect of the present invention, there is provided a control method for a locking/unlocking operation performed by a remote-control-operated locking/unlocking system which comprises a key for transmitting a locking/unlocking signal by remote control, and a locking/unlocking unit having control means for controlling a locking/unlocking operation based on the locking/unlocking signal transmitted from the key, the method comprising the steps of: determining the suitability of the locking/unlocking signal transmitted from the key; and providing information representing the unsuitability of the key based on a determination made by the determining step.

With the above arrangement, when a locking/unlocking operation fails to be performed, the user is able to know the reason for the failure. Thus, the security by this system can be fully achieved.

The locking/unlocking system of this invention determines the suitability of the use of a key, and based on a determination, performs a locking/unlocking operation. If it is found that the key is not suitable or should be prevented from being used, the corresponding information is provided. Hence, it is very useful to the user, and the security can be fully achieved.

DESCRIPTION OF THE PREFERRED EMBODIMENTS

Embodiments of a remote-control-operated locking/unlocking system according to the present invention will now be explained with reference to the drawings.

Figure 1:
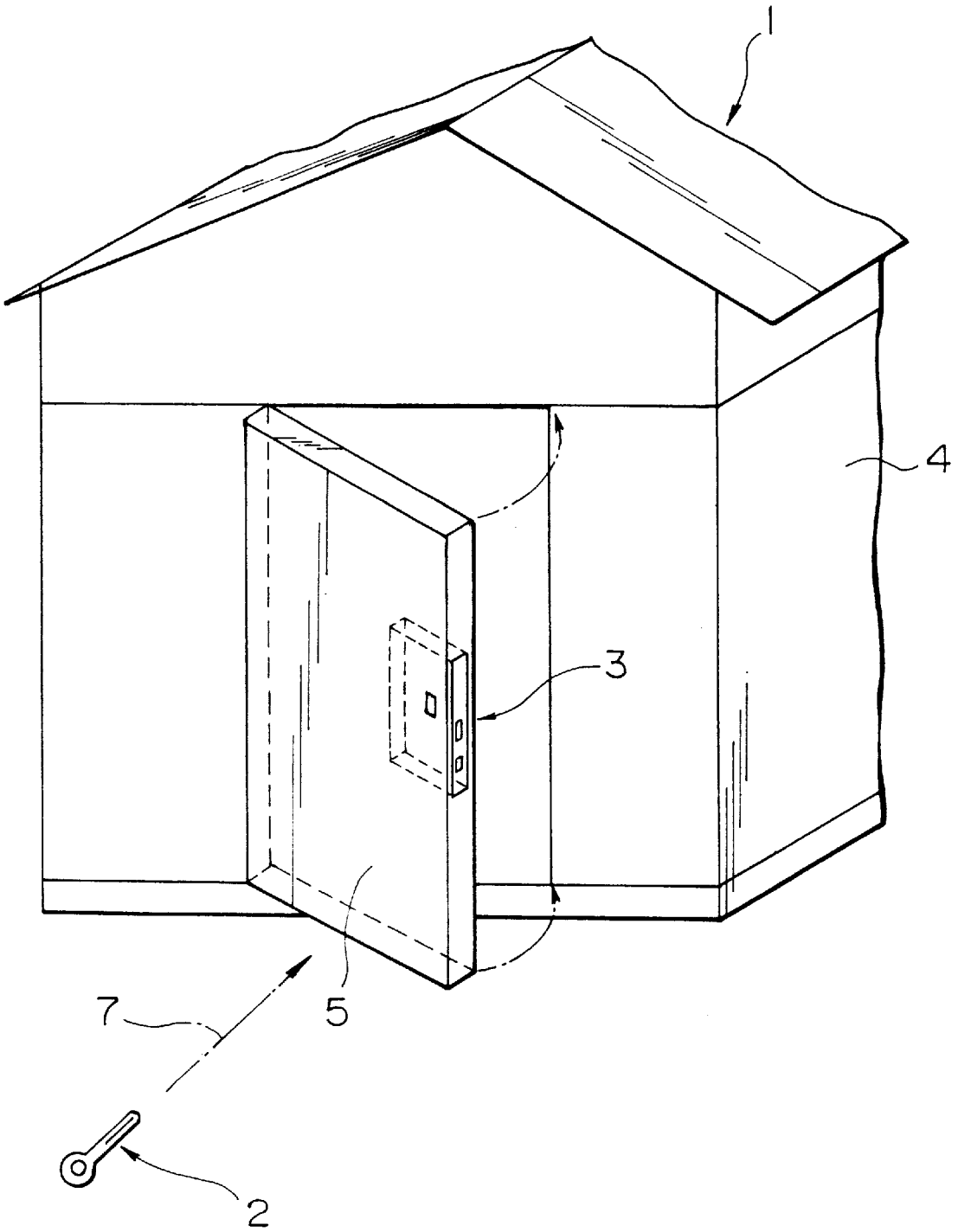
FIG. 1 is a schematic perspective view of a locking/unlocking unit, which serves as a receiver, fixed in the door.

A remote controller 1 for a locking/unlocking unit according to the present invention is formed of, as shown in FIG. 1, a plurality of keys 2, each serving as a transmitter, and a locking/unlocking unit 3, serving as a receiver, which is driven by a remote control operation performed by the key 2. The key 2 is portable, and the locking/unlocking unit 3 is, for example, built into a door 5 of a house 4 from its lateral surface.

The keys 2 are general-purpose keys when they are initially manufactured. A variety of unique codes are provided for the keys 2 when they are shipped. The individual identification code provided for the key 2, which is represented by the code other than the code in which all of the bits are expressed by "0" or "1", is able to designate the key specifically used for the locking/unlocking unit 3 only when and after the identification of the locking/unlocking unit 3 is registered.

Figure 2:
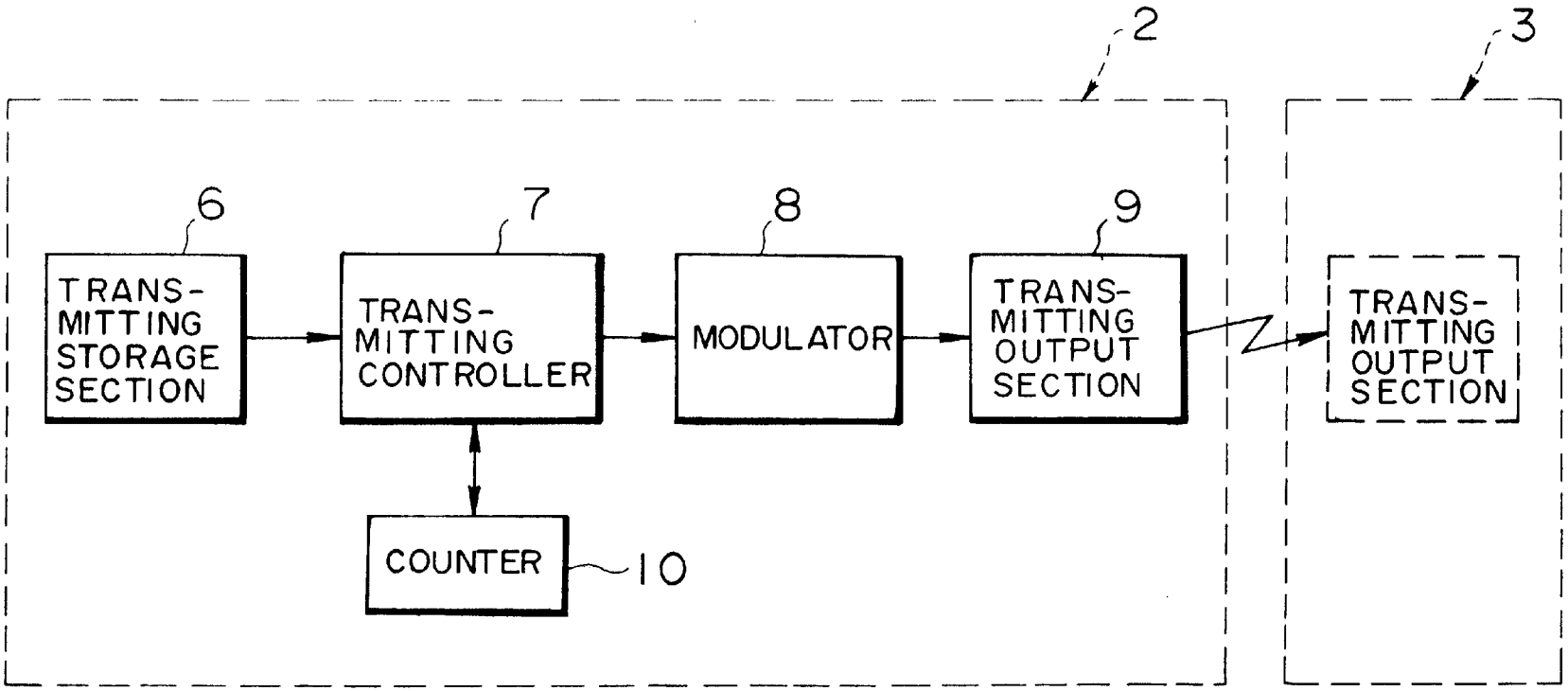
FIG. 2 is a block diagram illustrating the internal configuration of a controller which transmits a locking/unlocking signal from a key, which serves as a transmitter.

The internal system integrated into the key 2, which is configured to transmit a locking/unlocking signal by remote control, includes, as shown in FIG. 2, the following elements. A transmitting storage section 6 stores a code to form a locking/unlocking signal and a value of a counter. A transmitting controller 7 generates a locking/unlocking signal and encodes it from the code and the value of the counter stored in the transmitting storage section 6. A modulator 8 modulates the locking/unlocking signal encoded by the transmitting controller 7. A transmitting output section 9 outputs the modulated locking/unlocking signal in the form of an infrared signal or a radio wave. A counter 10 variously outputs the counter value every time a locking/unlocking signal is output.

Figure 3:
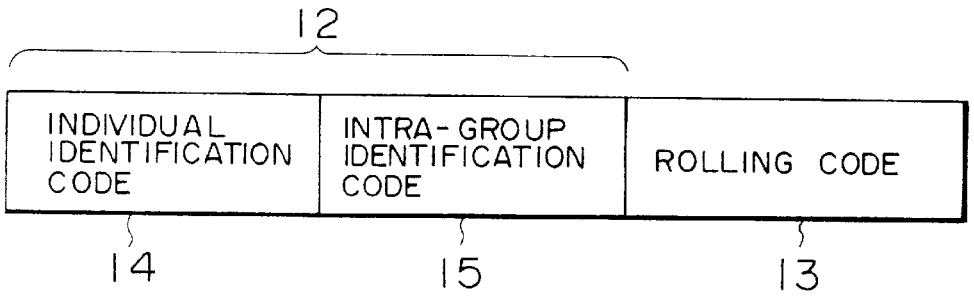
FIG. 3 illustrates the configuration of a locking/unlocking signal.

A locking/unlocking signal is formed, as illustrated in FIG. 3, of an identification code 12, and a rolling code 13 which varies by the use of the key 2 in accordance with predetermined rules.

The identification code 12 consists of an individual identification code 14 which is uniquely provided for the key 2 when manufactured and shipped, and an intra-group identification code 15 which individually specifies a plurality of keys 2 that are designated by the locking/unlocking unit 3 used as the receiver.

The individual identification code 14, which is uniquely provided for each key 2 when manufactured and shipped, is specified when the identification of the locking/unlocking unit 3 is registered. Accordingly, the individual identification code 14 representing a group of a plurality of keys 2 to be specified is expressed by a group of unique nonconsecutive codes. If a single key 2 only is used to form the individual identification code 14, it may be specified as a single key within a group.

The intra-group identification code 15, which designates the individual keys 2 within a group, is set when the identification of the below-described locking/unlocking unit 3 is registered. The intra-group identification code 15 has extra bits among the bits forming this code 15. In this embodiment, three bits are used, and a maximum of eight types of keys are able to be set. For example, if one group consists of eight keys 2, the locking/unlocking operation of one locking/unlocking unit 3 can be remotely controlled by the eight keys 2.

Two types of rolling codes 13, one for odd numbers and the other for even numbers, are available, which determine whether or not each of the keys 2 forming a group is suitable when in use. The rolling code 13 switches each locking/unlocking signal between odd-number data or even-number data every time a signal is transmitted, and the resulting odd-number data or the even-number data is output. The rolling code 13 has a built-in counter code which counts up every time data transmission is performed. For example, the following types of counter codes are considered: 1. counting up by "1" for each data transmission; 2. counting up by "n" (for example, n=3, 5, . . .) for each data transmission; and 3. generating random numbers. The rolling code 13 is not restricted to the above types, though. A rolling code 13 having 16 bits and using the counter code with predetermined rules, such as those shown above, enables the key 2 to be used approximately 65,000 times. If the key 2 is used about eight times a day (performing remote control operations eight times), the data which is variable for every data transmission can be used for about 20 years.

In this manner, the rolling code 13 integrating the counter code which is variable for every data transmission is contained in a locking/unlocking signal. When the locking/ unlocking signal is transmitted, the rolling code 13 can be monitored by the locking/unlocking unit 3 to analyze how the operator (owner) uses the key 2. It is thus possible to determine the suitability of the key 2 when in use.

In the foregoing technique, it is determined that the key 2 is suitably used as long as the following conditions are met. The remote control operation performed by the key 2 matches the way of using the key 2 (expectation value), which is stored in the locking/unlocking unit 3 fixed in a door, within a predetermined range. Alternatively, even if the matching state of the above two factors exceeds a predetermined range, the suitability of the key 2 is determined as long as they conform to predetermined rules. Accordingly, if it is desired that the use of the key 2 should be prevented due to the loss or the theft of the key 2, it is essential only that the individual identification code 14 corresponding to the key 2 be erased rather than using the rolling code 13.

Figure 4:
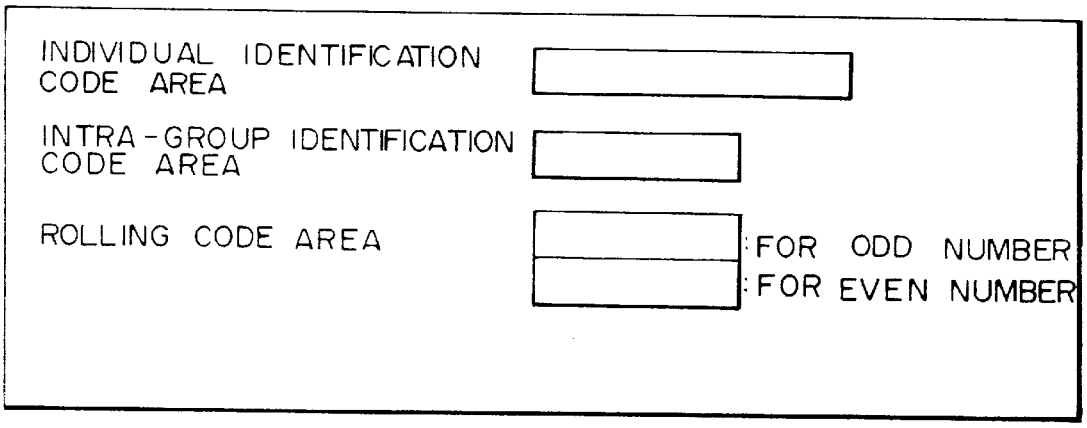
FIG. 4 illustrates the memory areas in a storage section of the key in which codes are stored.

The individual identification code 14, the intra-group identification code 15, and the rolling code 13, all of which form a locking/unlocking signal, are stored, as shown in FIG. 4, in the individual identification code area, the intra-group identification code area, and the rolling code area, respectively, in the memory (in this embodiment an Electrically Erasable Programmable Read Only Memory (EEPROM)) of the transmitting storage section 6. These codes are read to generate a locking/unlocking signal every time a remote control operation is conducted, and the signal is then encoded and transmitted to the locking/unlocking unit 3.

The locking/unlocking unit 3, which serves as the receiver, built into a door, will now be described while referring to the drawing.

The locking/unlocking unit 3 has, as shown in FIG. 5, a built-in power supply section, such as a primary cell, basically free from power supply from an exterior source, and is integrally formed into a case including a lock which is locked/unlocked by operating the key 2. The locking/unlocking unit 3 is locked or unlocked by its following two functions: by directly inserting the portable key 2 into a locking/unlocking mechanism or by being electrically powered, which is referred to as "by remote control operation".

Figure 5A:
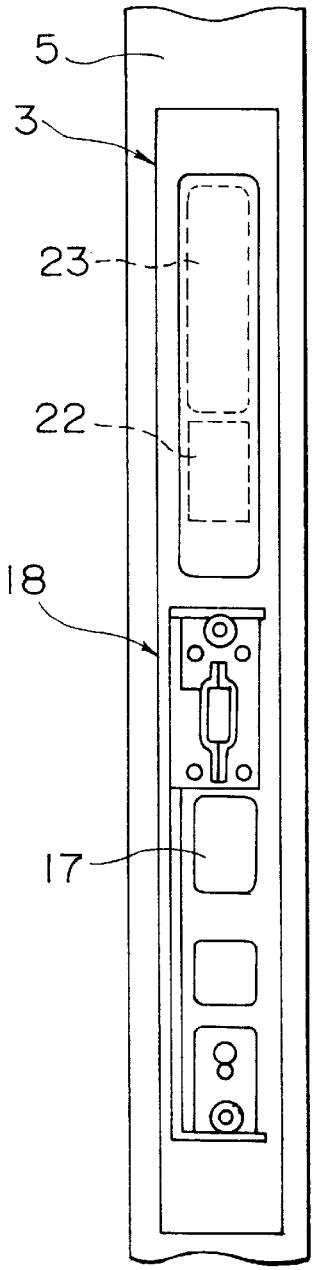
FIG. 5, which is comprised of FIGS. 5A, 5B and 5C, is a schematic plan view illustrating the overall configuration of the locking/unlocking unit and the key.
Figure 5B:
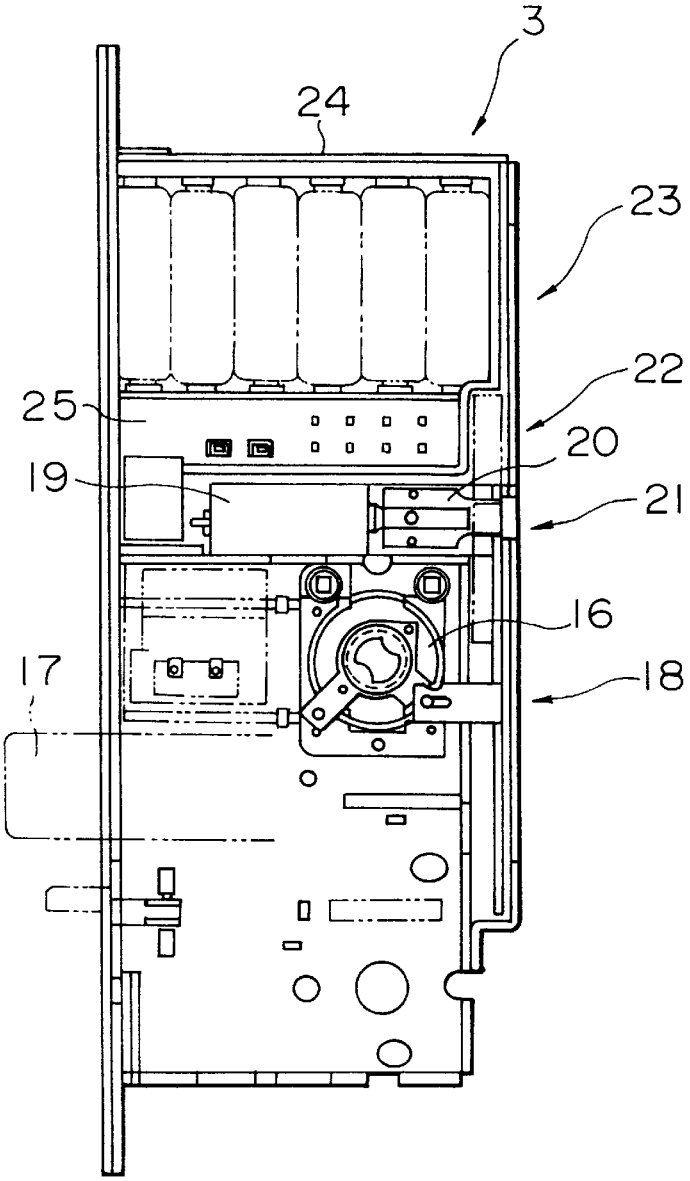
Figure 5C:
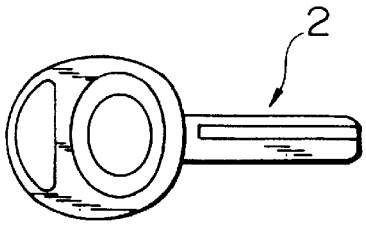

The locking/unlocking unit 3 includes, as shown in FIGS. 5A, 5B, and 5C, the following elements. A locking/unlocking mechanism 16 is locked or unlocked by inserting the key 2, which serves as the transmitter, thereinto. A driven section 18 shifts the locking/unlocking mechanism 16 to the locking or unlocking position through the operation of the key 2 or by being electrically driven so as to cause a striker 17 to project or to be retracted. A driving section 21 has a motor 19 serving as a driving source which is electrically powered, and a clutch 20 interconnected to the motor 19. A controller 22 has the following functions of: receiving a locking/unlocking signal (FIG. 1) transmitted when a remote control operation is performed by the key 2, determining the suitability of the locking/unlocking signal, controlling the operation of the motor 19 provided for the driving section 21, and specifying, deleting and changing the codes forming the locking/unlocking signal transmitted from the key 2. The locking/unlocking unit 3 also has a power supply section 23. These elements are integrated into a case 24, which is then fixed in the door 5. The locking/unlocking unit 3 is thus ready for use. The controller 22 and the power supply section 23 are removable from the lateral surface of the door 5 if necessary.

The driven section 18 is configured to independently perform locking/unlocking operations by being electrically powered or by inserting the key 2 into the locking/unlocking mechanism 16. When the locking/unlocking operation is performed by inserting the key 2 into the locking/unlocking mechanism 16, the clutch 20, which transmits power of the motor 19, is adapted to be released.

As illustrated in FIG. 5B, the controller 22 has an operation panel 25 on the external surface which contains a printed board provided with a memory. The controller 22 causes the locking/unlocking mechanism 16 to be locked or unlocked by the remote control performed by the key 2, and also monitors the suitability of the use of the key 2. When the controller 22 concludes that the use of the key 2 is unsuitable, it prohibits the execution of a locking/unlocking operation and also reports the information indicating that the use of the key 2 is unsuitable.

The operation panel 25 is operated mainly when the identification registration or deletion of the key 2 is conducted. The identification of the key 2 is registered so that the codes representing the locking/unlocking signal transmitted from the key 2 can be matched to the expectation values stored in the locking/unlocking unit 3. Thus, the general-purpose key 2 is changed into one of the unique eight keys 2 that can be used for the locking/unlocking unit 3.

When the identification registration is made as described above, the key 2 can be inserted into the locking/unlocking mechanism 16 to simultaneously set both of the codes stored in the transmitting storage section 6 (FIG. 2) of the key 2 and the expectation values stored in the storage section of the locking/unlocking unit 3 in synchronization with each other.

The codes transmitted from the key 2 do not have to exactly coincide with the expectation values stored in the locking/unlocking unit 3, and the matching state between the two factors merely based on predetermined rules sufficiently ensures the suitable use of the key 2. In other words, it is adequate only that the matching state between the codes indicating the locking/unlocking signal transmitted from the key 2 and the expectation values set in the locking/unlocking unit 3 falls within a predetermined range or conform to predetermined rules.

The codes of the key 2 stored in the locking/unlocking unit 3 are deleted when the ID-registered key 2 will no longer be used, the use of the key 2 should be prevented, and the key 2 cannot be used. If the codes of the key 2 are erased, a determination is not made on the suitability of the key 2 so as to prevent a locking/unlocking operation, and the information concerning that the use of the key 2 is unsuitable is reported.

A first embodiment of the controller 22 for determining the suitability of the key 2 and used in the locking/unlocking unit 3 will now be explained.

Figure 6:
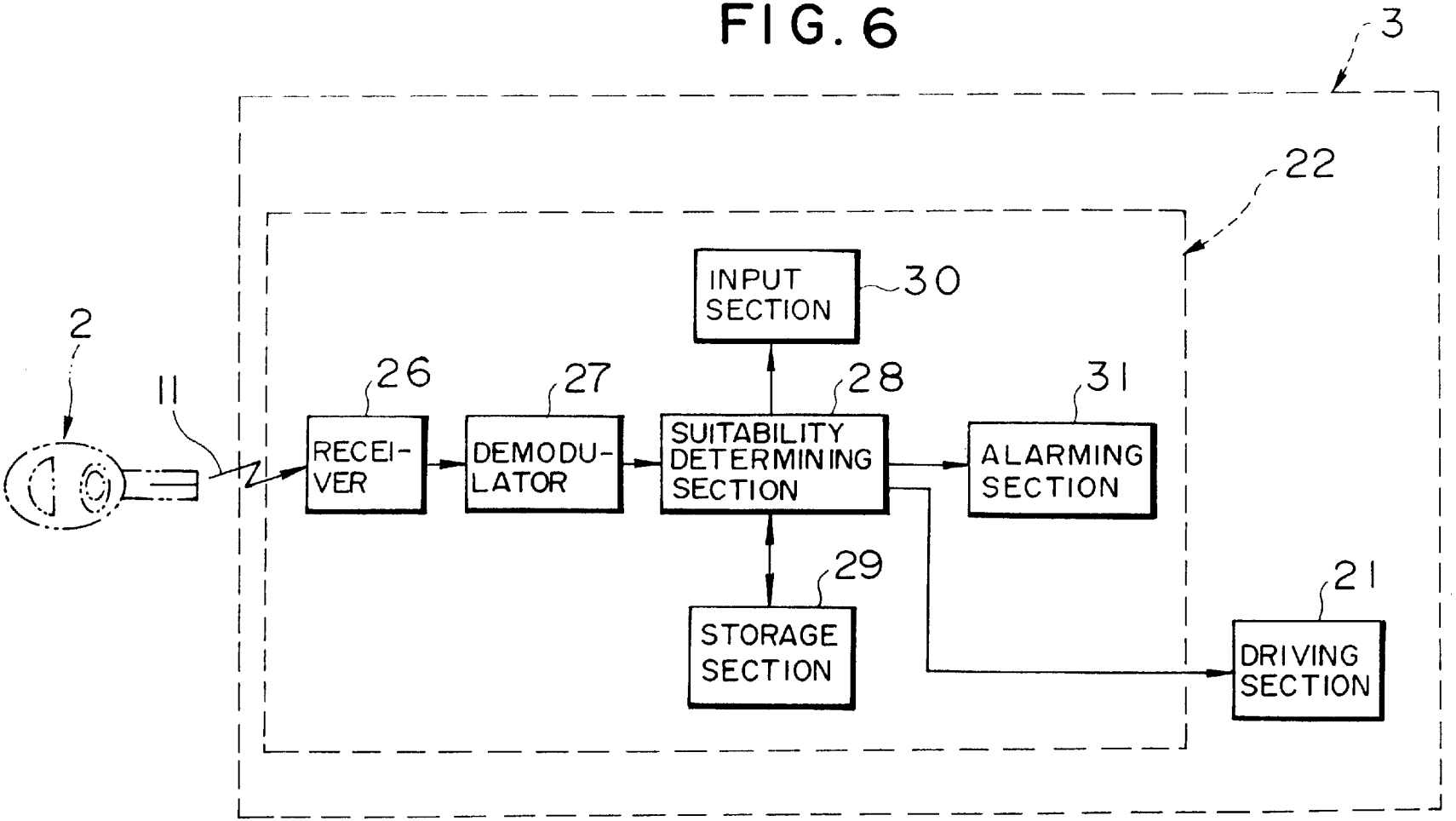
FIG. 6 is a block diagram illustrating the internal configuration of a first embodiment of the controller which controls the remote control operation performed on the locking/unlocking unit.

As illustrated in FIG. 6, the internal configuration of the controller 22 is constructed of the following elements. A receiver 26 receives a locking/unlocking signal from the key 2. A demodulator 27 demodulates the locking/unlocking signal received by the receiver 26. A suitability determining section 28 encodes the locking/unlocking signal to determine whether the key 2 is usable in the locking/unlocking unit 3 and whether the key 2 can be suitably used, and which also informs a determination made by this determining section 28, and upon determination, transmits a signal to drive the motor 19 (FIG. 5) of the driving section 21. A storage section 29 stores expectation values corresponding to the locking/unlocking signals transmitted from the respective keys 2. An input section 30 is operated to register or delete the codes representing the key 2 by actuating the operation panel 25 (FIG. 5). An alarming section 31 provides an alarm to the user by issuing a buzzer sound, or a melodious or onomatopoeic sound that the operated key 2 is not suitable or cannot be used.

Figure 7:
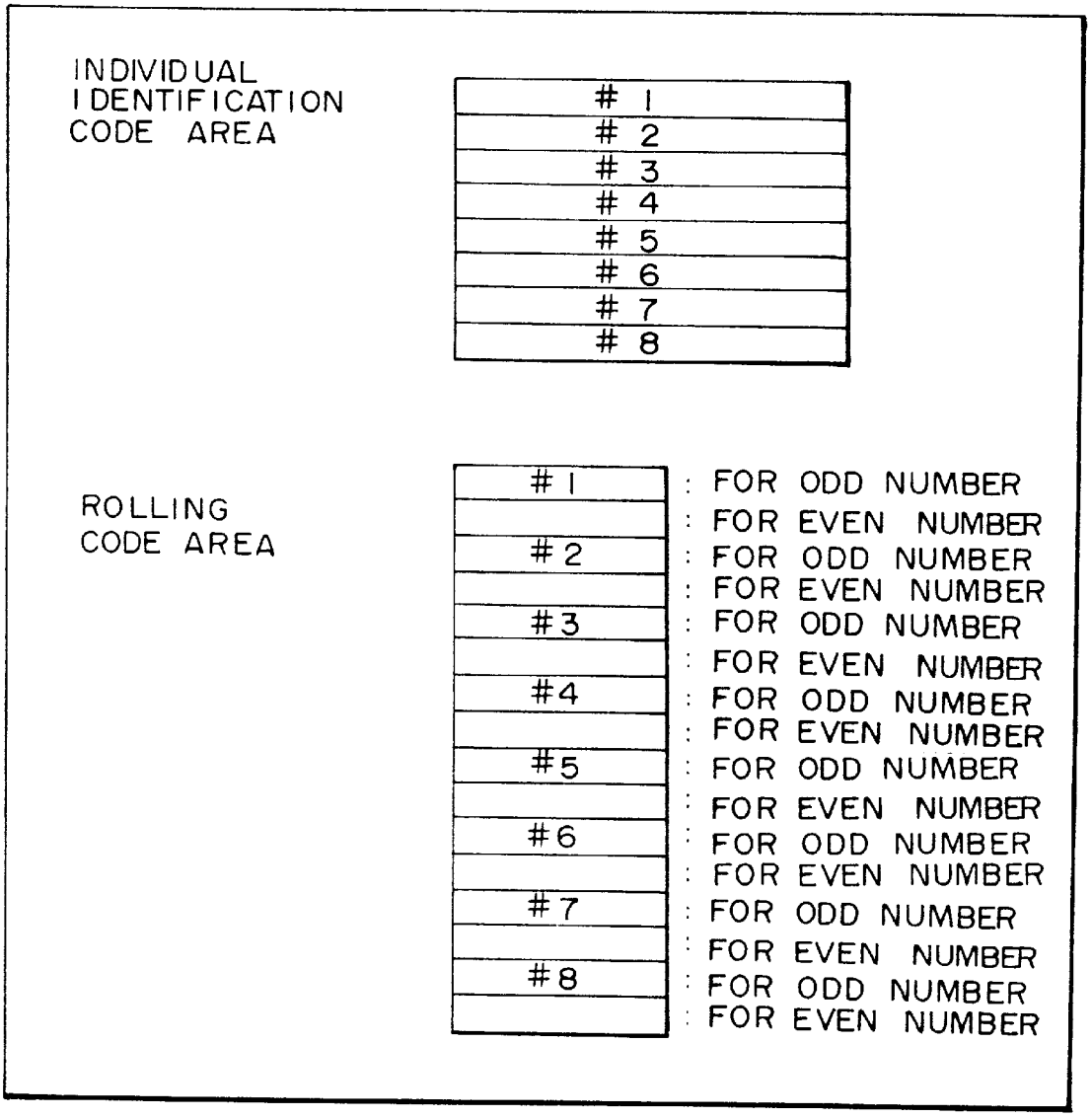
FIG. 7 illustrates the allocation of the memory areas in the storage section of the controller.

The storage section 29 has areas in which the expectation values corresponding to the individual identification code 14 representing a maximum of eight keys 2 contained in the locking/unlocking signal shown in FIG. 3 and the expectation values corresponding to the rolling code 13 shown in FIG. 3 are stored. More specifically, as illustrated in FIG. 7, the storage section 29 has eight areas #1 through #8 in which the expectation values corresponding to the individual identification code 14 and the rolling code 13 are stored. Which area from the areas #1 through #8 is selected is determined by the intra-group identification code 15 (a maximum of eight values) contained in a locking/unlocking signal. More specifically, the values of the intra-group identification code 15, which represent the different values inherent in the individual keys 2 formed into a group, are generally set in ascending or descending numeric order from a first key to an eighth key.

The expectation values stored in the respective areas corresponding to the rolling code 13 are each formed of an odd-number area and an even-number area. Each area is configured in a manner similar to the rolling code 13 transmitted from the key 2. The expectation values stored in the areas associated with the rolling code 13 are used to be compared with the rolling code 13 sent from the key 2, and upon comparison, the suitability of the use of the operated key 2 is determined. The received rolling code 13 is overwritten and updated as required.

A description will now be given of the suitability determining means which determines whether or not the rolling code 13 representing the decoded locking/unlocking signal transmitted from the key 2 matches the expectation values stored in the locking/unlocking unit 3.

Such a determination is first made by calculating a difference between the rolling code 13 which is variable for every signal transmission and the expectation value. If the difference conforms to the following predetermined rules, it is judged that the operated key 2 is suitable.

(1) If the rolling code 13 transmitted from the key 2 is the same as the expectation value, it is determined that the key 2 is suitable for the locking/unlocking unit 3.

(2) If the rolling code 13 from the key 2 is smaller than the expectation value, it is judged that the key 2 is not suitable for the locking/unlocking unit 3. The reason for this determination is based on the fact that the expectation value is set as the same value as the rolling code 13 when ID of the key 2 is registered, and that in this embodiment the counter constantly counts up every time a signal is transmitted from the key 2. The above determination does not apply to the case where the counter code is updated by generating random numbers.

(3) If the rolling code 13 from the key 2 fails to be received and is greater than the expectation value whose difference m is expressed by, for example, $m \leqq 16$, the rolling code 13 which was received this time is held, and it is further determined whether the rolling code 13 which is subsequently received coincides with the previous rolling code 13. If the answer is yes, it is concluded that the suitability of the key 2 is ensured.

(4) If the rolling code 13 from the key 2 fails to be received and is greater than the expectation value whose difference m is expressed by, for example, $16<m \leqq 256$, the rolling code 13 which was received this time is held, and it is further judged whether the rolling code 13 which is subsequently received meets the above-described conditions. If the answer is yes, it is concluded that the suitability of the key 2 is guaranteed.

(5) If the rolling code 13 from the key 2 cannot be received and is greater than the expectation value whose difference m is expressed by, for example, $m>256$, it is determined that the use of the key 2 is not suitable.

In the foregoing determinations, if it is determined that the key 2 does not match the locking/unlocking unit 3, such information is reported by means of a buzzer sound from the alarming section 31, and a locking/unlocking operation is made ineffectual. The key 2 which has been determined to be unsuitable for the locking/unlocking unit 3 can be re-used by synchronizing the rolling code 13 with the expectation value by inserting the key 2 into the locking/unlocking mechanism 16 (FIG. 5) and re-setting the ID code through the operation panel 25.

If the registered key 2 cannot be used or should be prevented from being used, i.e., if it is assumed that one of the keys 2 be lost, the code corresponding to the key 2 is deleted from the key group registered in the locking/unlocking unit 3, and a new key is registered if required.

If the deleted key 2 is used, a locking/unlocking operation is unable to be performed, and also, the information indicating that the key 2 is not suitable for the locking/unlocking unit 3 is provided. The brief reason for failing in using the key 2 may be provided by means of, for example, onomatopoeic sounds rather than simply giving the information by a buzzer sound. This urges a prompt response of the user and achieves the full implementation of the security.

Figure 8:
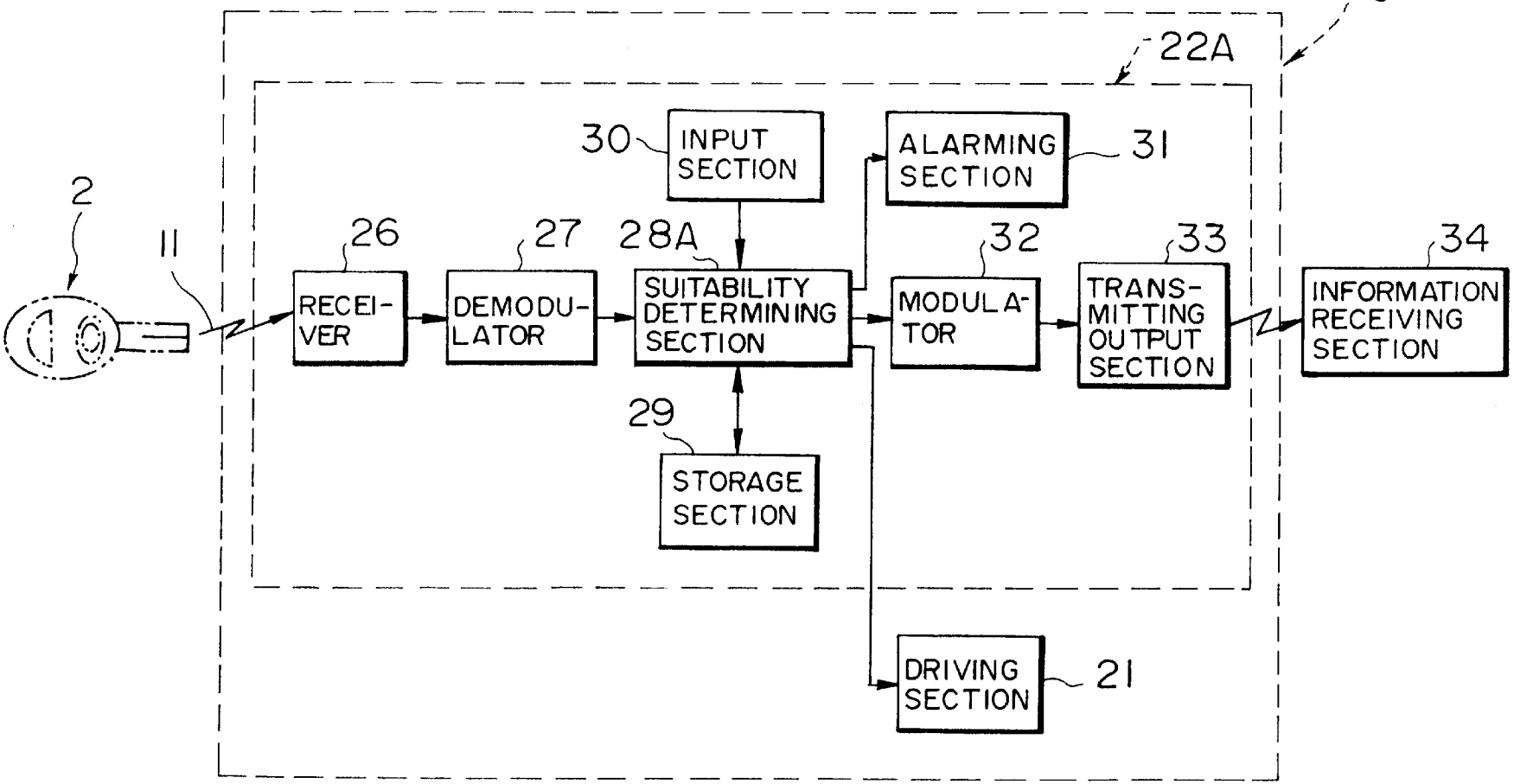
FIG. 8 is a block diagram illustrating the internal configuration of a second embodiment of the controller which controls the remote control operation performed on the locking/unlocking unit.

An explanation will now be given with reference to FIG. 8 of a second embodiment of the controller which determines the suitability of the key 2 and used in the locking/unlocking unit 3.

The internal configuration of the controller 22A which determines the suitability of the key 2 differs from the controller 22 shown in FIG. 6 in that a modulator and a transmitting output section are added to form information means which provides information to the exterior. The same elements as those of the first embodiment shown in FIG. 6 are designated by like reference numerals, and an explanation thereof will thus be omitted.

A suitability determining section 28A determines the suitability of a locking/unlocking signal received from the key 2. If the determining section 28A determines that the locking/unlocking signal is suitable, it transmits the signal to a driving section 21 to perform a locking/unlocking operation. On the other hand, if the determining section 28A judges that the locking/unlocking signal is not suitable, or that the key which is prohibited from being used is operated, an alarming sound, for example, a buzzer sound, is generated from an alarming section 31 to provide such information, and also a signal indicating the unsuitable use of the key 2 is modulated by a modulator 32, and the modulated signal is transmitted to a transmitting output section 33. The modulated signal representing the contents of the unsuitable use of the key 2 is notified to an external information-receiving section 34 by means of communications, such as by radio or by cable, for example, a telephone line. The information receiving section 34 is a person who manages the house 4 or the owner who owns the house 4 provided with the locking/unlocking unit 3 fixed in the door 5, as shown in FIG. 1.

In this manner, if a key 2 which is not suitable or can no longer be used is operated, a buzzer sound is issued to provide such information, and the contents of the unsuitable use of the key 2 are notified to people related to the locking/unlocking operation. Thus, the security can be enhanced over the first embodiment by providing information.

The configuration of the key 2, the contents of a locking/unlocking signal transmitted from the key 2, and the encoding/decoding operation are similar to those of the first embodiment, and an explanation thereof will thus be omitted.

Although in the first and second embodiments the rolling code 13 which determines the suitability of the use of the key 2 is provided for the key 2 serving as the transmitter, it may be provided for the locking/unlocking unit 3 serving as the receiver.

What is claimed is:

1. A remote-control-operated locking/unlocking system comprising:

a locking/unlocking unit; and a key having an element for manual insertion into said locking/unlocking unit and a remote control unit for transmitting a locking/unlocking signal by remote control, said locking/unlocking unit having a locking/unlocking mechanism for insertion thereinto of said element of said key and control means for controlling a locking/unlocking operation based on the locking/unlocking signal transmitted from said key, said control means including determining means for determining suitability of the locking/unlocking signal transmitted from said key, and information means arranged inside of said locking/unlocking unit for providing audible information to a user of said key indicating that said key is unsuitable and ineffective based on the suitability determination made by said determining means.

2. The remote-control-operated locking/unlocking system according to claim 1, wherein said key comprises a counter for outputting a counter value every time the locking/unlocking signal is transmitted, a transmitting storage section for storing a predetermined code and the counter value from said counter, a transmitting controller for encoding the locking/unlocking signal in accordance with a predetermined code and for encoding the counter value from said counter stored in said transmitting storage section, a modulator for modulating the locking/unlocking signal encoded by said transmitting controller, and a transmitting output section for outputting the locking/unlocking signal modulated by said modulator.

3. A remote-control-operated locking/unlocking system according to claim 2, wherein said predetermined code comprises an identification code, and a rolling code which varies by the use of said key in accordance with a predetermined rule.

4. A remote-control-operated locking/unlocking system according to claim 3, wherein said identification code comprises an individual identification code which is unique to a key, and an intra-group identification code which specifies each of a plurality of keys formed into a group.

5. The remote-control-operated locking/unlocking system according to claim 1, wherein said locking/unlocking unit having said control means and said locking/unlocking mechanism driven by manual insertion of said key element, comprises: a driven section for shifting said locking/unlocking mechanism to a locking/unlocking position; a driving section having a clutch that transmits power from a driving source to said locking/unlocking mechanism; a controller which receives the locking/unlocking signal from said key for determining the suitability of the user of said key, and upon suitable determination, drives said driving section; and a power supply section.

6. A remote-control-operated locking/unlocking system according to claim 5, wherein said controller and said power supply section are integrally formed each other and are made detachable.

7. The remote-control-operated locking/unlocking system according to claim 6, wherein said driven section performs a locking/unlocking operation by one of being driven by said power supply section and by inserting said key element into said locking/unlocking mechanism.

8. The remote-control-operated locking/unlocking system according to claim 1, wherein said information means comprises means for modulating an output signal from said determining means representing the unsuitable use of the key and a transmitting output section receiving the modulated signal from said means for modulating and outputting a signal for informing an unsuitable use of the key by communications to a person other than the user of the key.

9. A control method for a locking/unlocking operation performed by a remote-control-operated locking/unlocking system having a key for transmitting a locking/unlocking signal by remote control and a locking/unlocking unit having control means for controlling a locking/unlocking operation based on the locking/unlocking signal transmitted from said key, said method comprising the steps of:

determining the suitability of the locking/unlocking signal transmitted from said key;

providing information to a user of said key by emitting from inside of the locking/unlocking system an audible sound indicating an unsuitable use and that the key is ineffective based on a determination made in said determining step; and providing information to a person at a location remote from a location of the user of said key indicating the unsuitability of the key based on the determination made in said determining step.

* * * * *